US007621165B2

(12) United States Patent
Boltz

(10) Patent No.: US 7,621,165 B2
(45) Date of Patent: Nov. 24, 2009

(54) CRIMP TOOL

(75) Inventor: David William Boltz, Powhatan Point, OH (US)

(73) Assignee: Wheeling-Corrugating Company, Wheeling, WV (US)

( * ) Notice: Subject to any disclaimer, the term of this patent is extended or adjusted under 35 U.S.C. 154(b) by 196 days.

(21) Appl. No.: 11/770,692

(22) Filed: Jun. 28, 2007

(65) Prior Publication Data

US 2008/0000062 A1 Jan. 3, 2008

Related U.S. Application Data

(60) Provisional application No. 60/817,828, filed on Jun. 29, 2006.

(51) Int. Cl.
*B21D 28/00* (2006.01)

(52) U.S. Cl. ..... 72/332; 72/325; 72/409.01

(58) Field of Classification Search ..... 72/325, 72/326, 327, 332, 333, 409.01, 409.11, 409.12, 72/409.13, 409.16, 409.18, 409.19, 413, 72/414, 481.3, 481.8; 29/243.5, 243.57, 29/432.2, 509, 521

See application file for complete search history.

(56) References Cited

U.S. PATENT DOCUMENTS 2,620,879 A * 12/1952 Fechter ..... 72/326
3,178,806 A * 4/1965 Keith ..... 29/890.042
3,411,339 A 11/1968 Brown
3,473,362 A * 10/1969 Black, Jr. et al. ..... 72/326
3,685,336 A * 8/1972 Black, Jr. ..... 72/325
3,877,286 A 4/1975 Fontaine et al.
4,037,512 A 7/1977 Sundberg
4,072,118 A 2/1978 Schultheiss
4,375,161 A 3/1983 Braun et al.
4,442,581 A 4/1984 Molnick
4,473,925 A 10/1984 Jansen
4,531,397 A 7/1985 Pratt
4,671,721 A 6/1987 Pratt et al.
4,821,419 A 4/1989 Lee
4,998,351 A * 3/1991 Hartmeister ..... 30/228
5,022,253 A * 6/1991 Parlatore ..... 72/325
5,312,218 A 5/1994 Pratt et al.
5,878,617 A 3/1999 Parker
6,212,932 B1 4/2001 Parker
6,308,402 B1 10/2001 Ellis
6,397,469 B2 6/2002 Parker
6,760,962 B2 7/2004 Seamons
6,938,452 B2 * 9/2005 Rudolph et al. ..... 72/325
6,990,781 B2 1/2006 Sundstrom
7,021,108 B2 4/2006 Bodwell
7,434,314 B2 * 10/2008 Morton ..... 29/897.31
7,484,397 B2 * 2/2009 Coelho et al. ..... 72/325

* cited by examiner

*Primary Examiner*—Edward Tolan
(74) *Attorney, Agent, or Firm*—Reed Smith LLP

(57) ABSTRACT

A power operated crimp tool having two movable jaws. On the lower end of one of the movable jaws there is pair of spaced punches and on the lower end of the other movable jaw there is a pair of spaced recesses. The first and second punches punch through layers of a decking seam from the same direction forming semi-circular penetrations with folds of alternating direction, one oriented upwardly and one oriented downwardly for 22, 20 and 18 gage thicknesses or both in the same direction for 16 gage.

11 Claims, 11 Drawing Sheets

PRE-PUNCH INTERLOCKING SEAM

CRIMPED INTERLOCKING SEAM FOLDED DOWN

CRIMPED INTERLOCKING SEAM FOLDED UP

SECTION "X-X"
BOTH TIPS UP FOR 16 GAGE

SECTION "X-X"
ONE TIP UP, ONE TIP DOWN

CRIMP TOOL

CROSS-REFERENCE TO RELATED APPLICATION

This application claims the benefit under 35 U.S.C. §119 (e) of the earlier filing date of U.S. Provisional Application Ser. No. 60/817,828 filed on Jun. 29, 2006, which is hereby incorporated by reference.

FIELD OF THE INVENTION

The present invention generally relates to tools used to join together overlapping flanges of structural steel decking and roofing.

BACKGROUND OF THE INVENTION

Steel decking is commonly used in the construction of the floors and roofs of buildings. The steel decking is formed from corrugated steel decking sections. On one side of the steel decking section there is an upright edge. On the other sides of the section of steel there is an envelope to receive the upright edge of the adjacent steel decking section.

The adjacent steel decking sections are bonded together. It is known to manually bond together adjacent steel decking sections with a manually operated button punch tool. The operator actuates the button punch tool and makes a dent in each side of the envelope of the steel decking section and also in the upright edge of the next adjacent steel decking section.

Various patents have issued with respect to such punch tools. Examples of punch tool patents are U.S. Pat. No. 5,878,617, issued on Mar. 9, 1999 to J. Parker; U.S. Pat. No. 6,212,932, issued on Apr. 10, 2001 to J. Parker; U.S. Pat. No. 6,397,469, issued on Jun. 4, 2002 to J. Parker; U.S. Pat. No. 7,021,108, issued on Apr. 4, 2006 to P. Bodwell; and U.S. Pat. No. 4,531,397, issued on Jul. 30, 1985 to R. Pratt ("the Pratt Patent"), the disclosures of which are incorporated by reference herein. The Pratt Patent describes a button punch tool which is pneumatically power operated. This crimp tool has two movable links. There are two punches on the lower end of one of the movable jaws and two recesses on the lower end of the other movable jaw. A pneumatically operated movable piston is operatively connected to a plunger. The plunger connects with suitable toggles and, in turn, the toggles connect with an appropriate movable link. The operator can control the application of power to the pneumatically operated movable piston so as to move the piston and thereby move the plunger and thereby move the toggles and the associated two movable jaws. The two punches located on the end of the punch tool provide a power-driven crimp to the adjoining sections of steel decking and roofing.

SUMMARY OF THE INVENTION

According to a preferred embodiment of the present invention, a power operated crimp tool having two movable jaws is disclosed. On the lower end of one of the movable jaws there is pair of spaced punches and on the lower end of the other movable jaw there is a pair of spaced recesses. The first and second punches punch through layers of a decking seam from the same direction forming semi-circular penetrations with folds of alternating direction, one oriented upwardly and one oriented downwardly for 22, 20 and 18 gage thicknesses or both in the same direction for 16 gage.

BRIEF DESCRIPTION OF THE DRAWINGS

The present invention and its presently preferred embodiments will be better understood by way of reference to the detailed disclosure herebelow and to the accompanying drawings.

DESCRIPTION OF THE PREFERRED EMBODIMENTS

Figure 1:
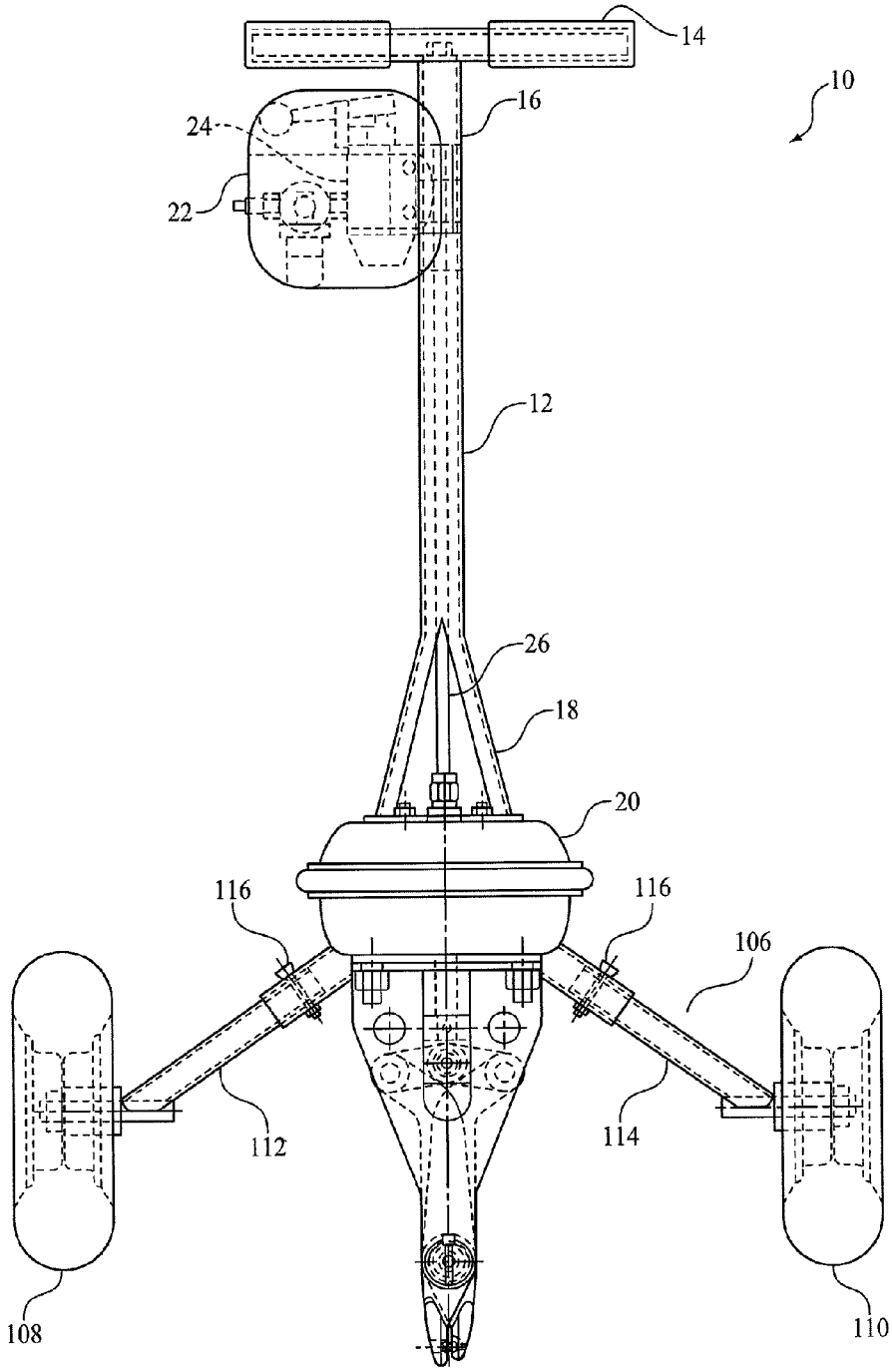
FIG. 1 is a front elevational view of the crimping tool according to one embodiment of the present invention with the jaws in the closed position.
Figure 5:
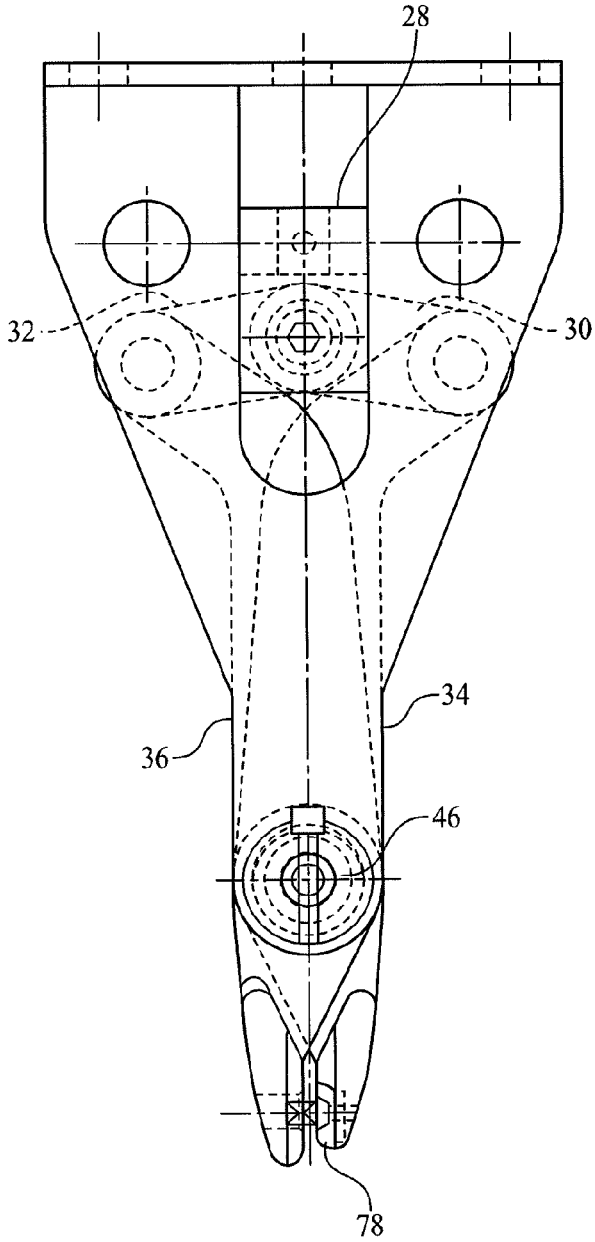
FIG. 5 is a fragmentary front view illustrating the lever mechanism for operating the jaws in a closed position.

Referring to FIG. 1, there is shown a crimp tool 10 in accordance with a preferred embodiment of the present invention. The crimp tool includes a handle frame 12 having a handle grip 14 mounted on a first end 16 of handle frame 12. During normal use, handle grip 14 is grasped by an operator for manipulation of crimp tool 10. Handle frame 12 includes a second end 18 connected to an actuator 20. Actuator 20 is preferably a pneumatic air bladder having a piston (not illustrated). Those of skill in the art will recognize that other types of actuators are within the scope of the present invention. Actuator 20 is operatively connected to a trigger assembly 22 mounted on the first end 16 of handle frame 12. Trigger assembly 22 is suitably positioned on frame 12 for convenient actuation by an operator. Trigger assembly 22 includes a valve 24 which when actuated allows air to enter into the air bladder through a tubing 26. The piston of actuator 20 is also operatively connected to a linkage 28 (FIG. 5). Linkage 28 preferably is a clevis pivotally connected to a pair of pushing links 30, 32 (FIG. 5). Pushing links 30 (comprising a double link) are pivotally connected to a punch jaw 34 while pushing link 32 is pivotally connected to a die jaw 36.

Figure 6A:
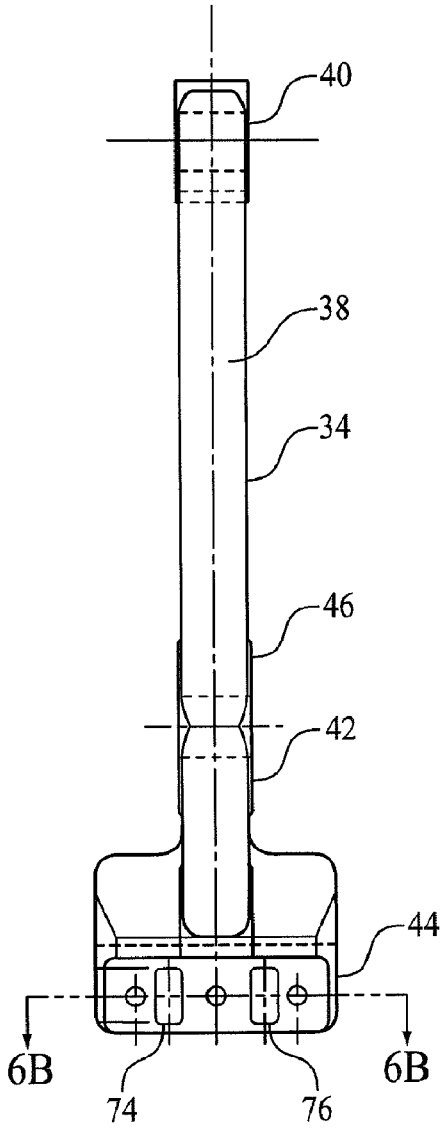
FIG. 6A is an end elevational view of the punch jaw.
Figure 7:
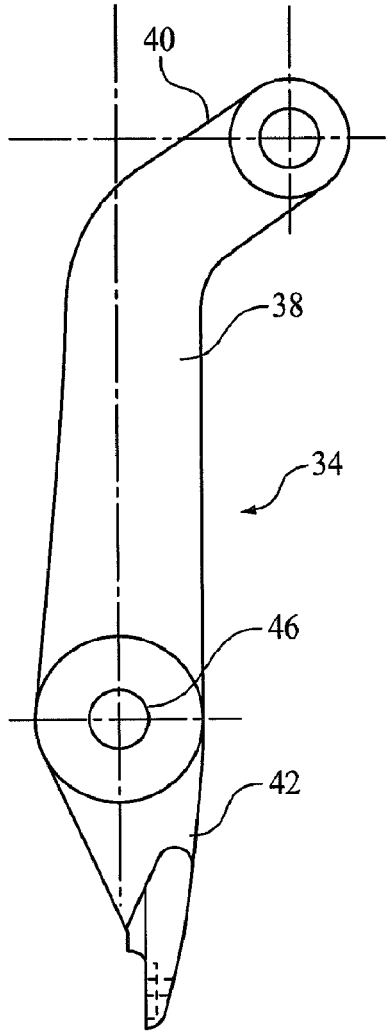
FIG. 7 is a side elevational view of the punch jaw.
Figure 6B:
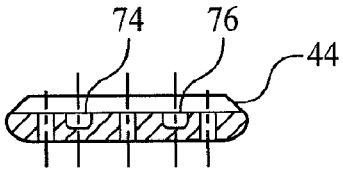
FIG. 6B is cross-sectional view through line 6B-6B of FIG. 6A.

Punch jaw 34 (FIGS. 6A-7) includes a single leg 38 having a first driven end 40 pivotally connected to pushing links 30 and a second free end 42 having a punch base member 44. The punch jaw 34 is pivotally connected to die jaw 36 at a pivot 46 intermediate its first end 40 and second end 42. Base member 44 of punch jaw 34 preferably includes a pair of first and second spaced punches 48, 50.

Figure 4:
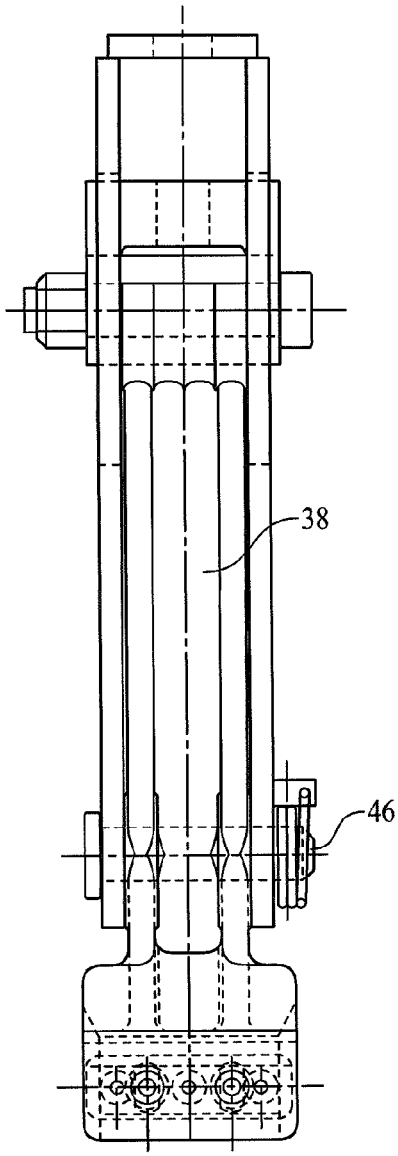
FIG. 4 is a side elevational view of the lever mechanism of the present invention.
Figure 8A:
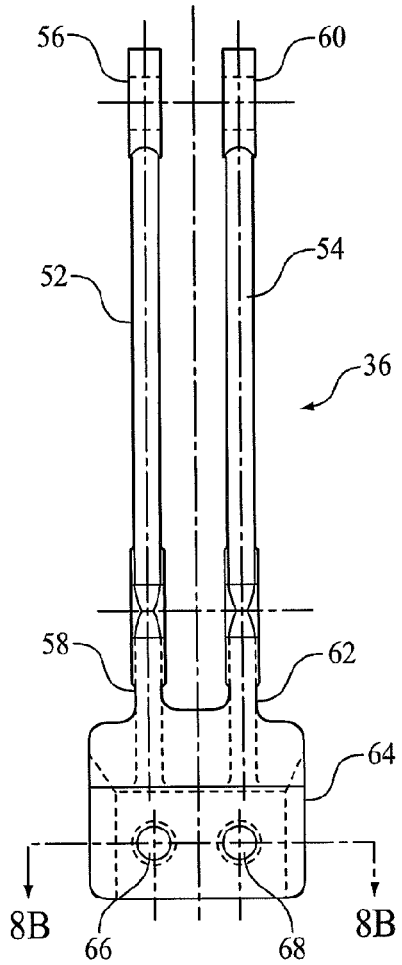
FIG. 8A is an end elevational view of the diejaw.
Figure 9:
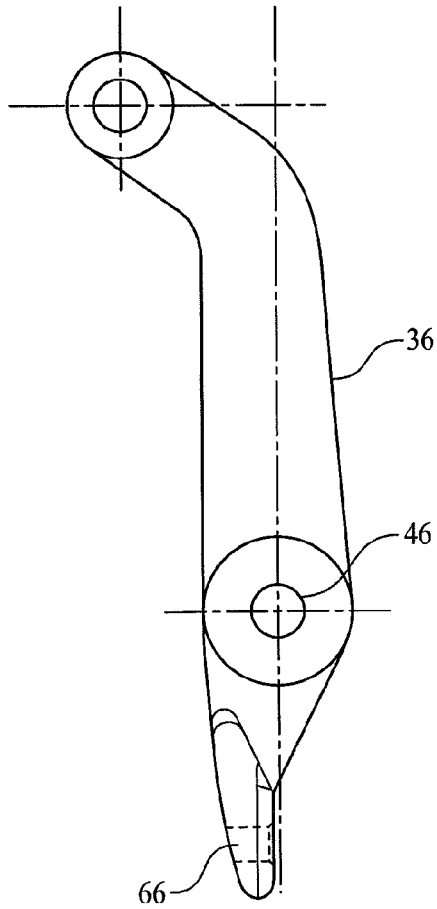
FIG. 9 is a side elevational view of the die jaw.
Figure 8B:
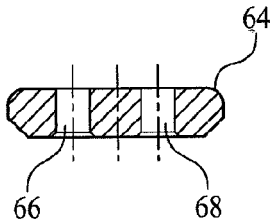
FIG. 8B is cross-sectional view through line 8B-8B of FIG. 8A.
Figure 10A:
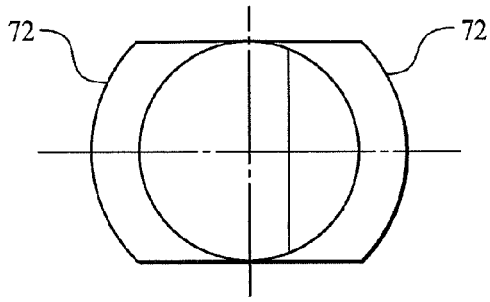
FIGS. 10A-10D are front, side, back and perspective views of the punch of the present invention.
Figure 10B:
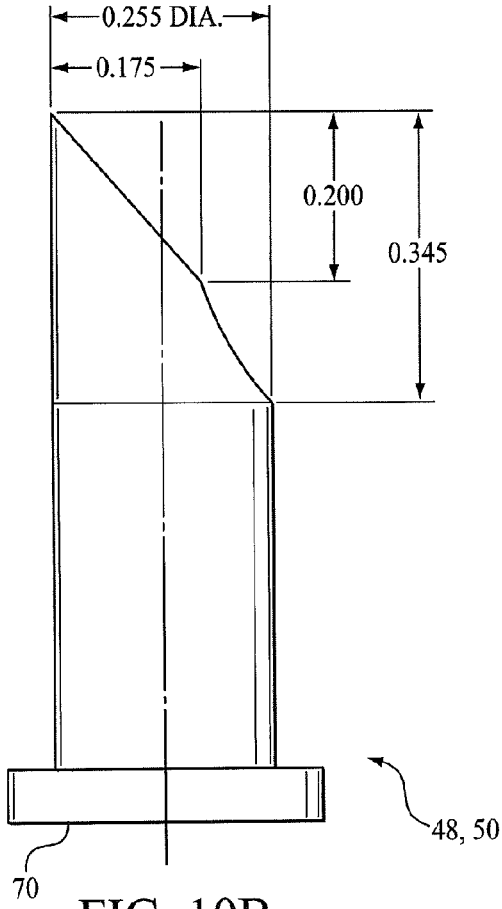
Figure 10C:
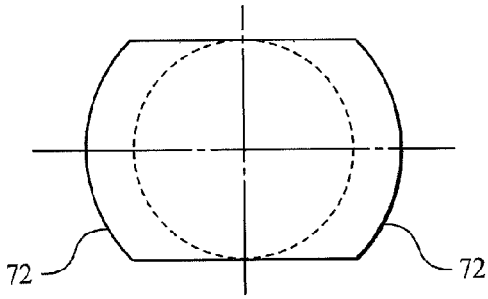
Figure 10D:
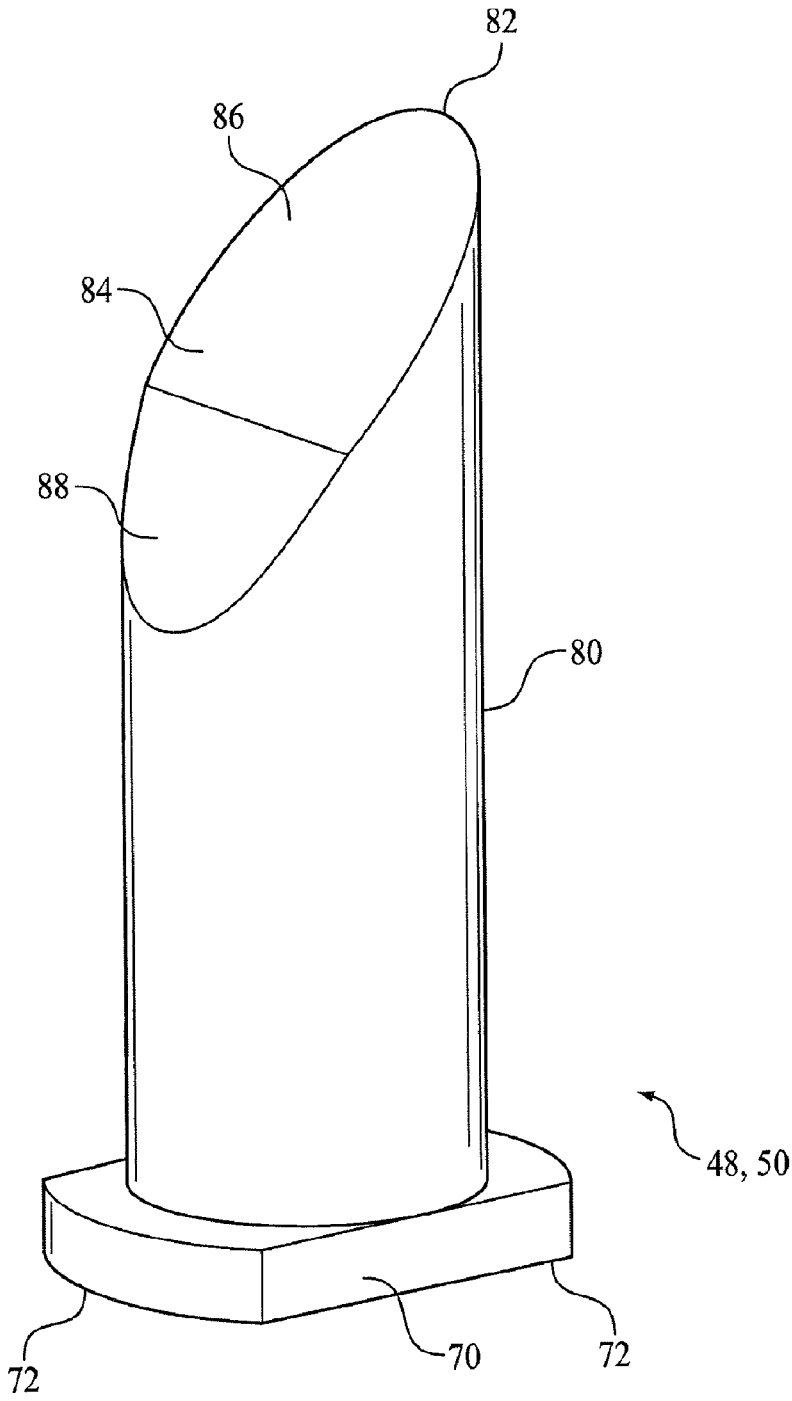

Die jaw 36 (FIGS. 8A-9) includes a pair of spaced legs 52, 54 having first driven ends 56, 60 connected to pushing link 32 and second free ends 58, 62 connected to a die base member 64. Die base member 64 preferably includes a pair of first and second spaced recesses 66, 68. Leg 38 of punch jaw 34 is receivable in between legs 52, 54 of the die jaw 36 (FIG. 4).

Each punch 48, 50 (FIGS. 10A-10D) has a capped end 70 having a pair of flanges 72. Punch jaw base member 44 further has a pair of rectangularly shaped recesses 74, 76. Each capped end 70 is receivable in one of the recesses 74, 76 in punch jaw base member 44. The punch jaw 34 is preferably equipped with a hold plate 78 attachable to punch jaw 34 with screws (not illustrated) to hold the capped end 68 in place. Alternatively, the punches 48, 50 may have a threaded end portion which is receivable in a corresponding threaded opening of the punch jaw base member 44. The punches can easily be exchanged for new punches when worn or broken without having to remove the entire jaw from the crimp tool.

Each punch 48, 50 has a cylindrical end 80 opposite capped end 70. Cylindrical end 80 has a chisel-tipped end portion 82. The chisel tipped portion 82 has a beveled portion 84 including a distal planar beveled portion 86 which is at an angle of about 45° to the lateral axis of the punch; and an intermediate planar beveled portion 88 sloped at an angle of less than 45°. The beveled portion 84 extends substantially across the entire cross-section diameter of the cylindrical end 80.

The rectangular shape of the punch jaw base member recesses 74, 76 allows the punches 48, 50 to be oriented in one of two directions—either with the chisel tip 82 oriented upwardly or with the chisel tip 82 oriented downwardly. According to a preferred embodiment of the present invention, a first punch 48 is rotated upwardly such that the beveled portion 84 of the chisel tipped portion 82 is disposed in a first direction while the second punch 50 is rotated downwardly such that its beveled portion 84 of its chisel tipped portion 82 is disposed in a second direction opposite the first direction.

Figure 11:
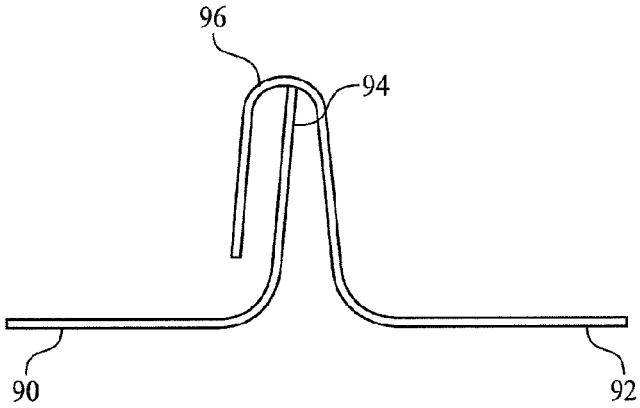
FIG. 11 is an end view of two adjacent corrugated steel forms or two adjacent corrugated sheets illustrating the upright edge of a first steel form with the upright edge being in the envelope of the second steel form and before the envelope and the upright edge have received crimps.
Figure 12:
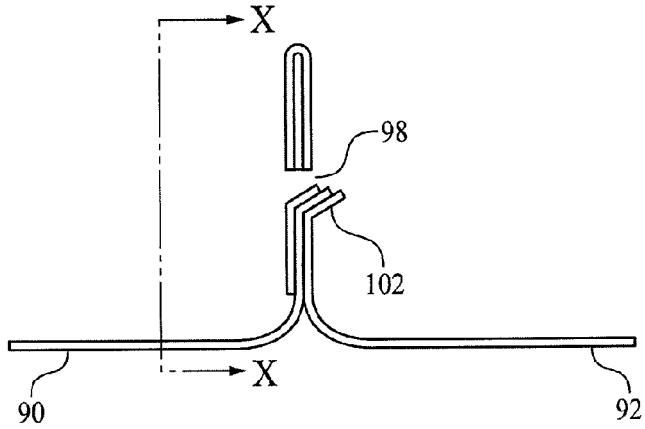
FIG. 12 is an end view illustrating the upright edge in the envelope of the next adjacent sealed form and after the upright edge and the envelope have been punched and crimp folded down.
Figure 13:
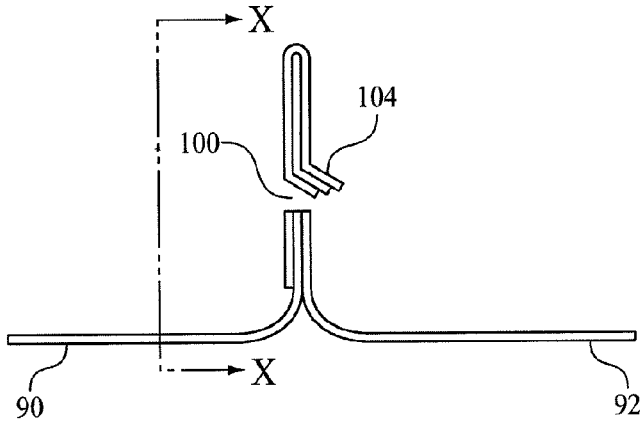
FIG. 13 is an end view illustrating the upright edge in the envelope of the next adjacent sealed form and after the upright edge and the envelope have been punched and crimp folded up.
Figure 14:
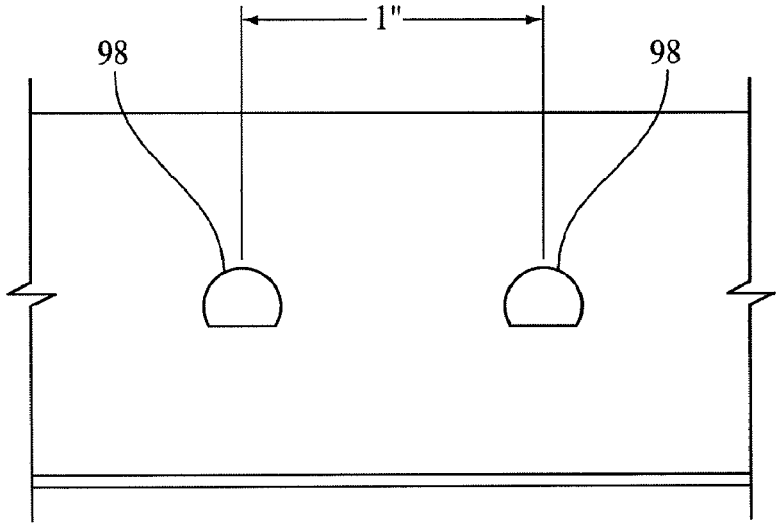
FIG. 14 is a fragmentary side view illustrating the envelope and the upright edge in the envelope and two punches together forming a crimp for 16 gage material.
Figure 15:
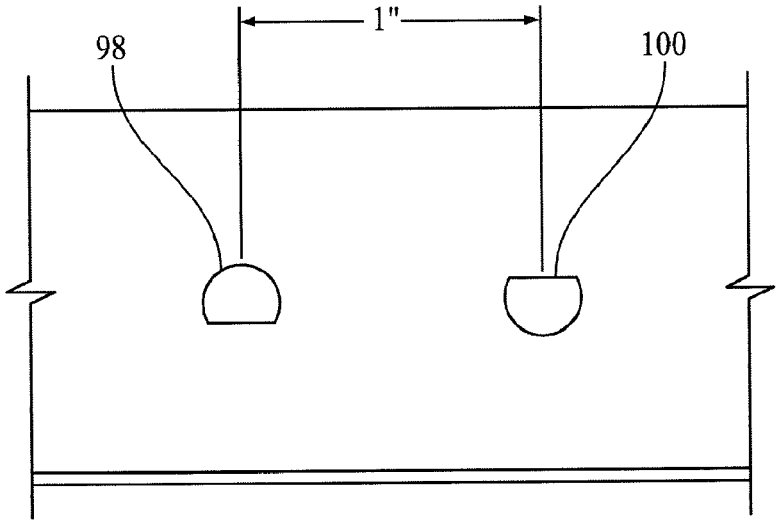
FIG. 15 is a fragmentary side view illustrating the envelope and the upright edge in the envelope and two punches together forming a crimp for 22, 20, 18 gage material one folded up and one folded down.
Figure 16:
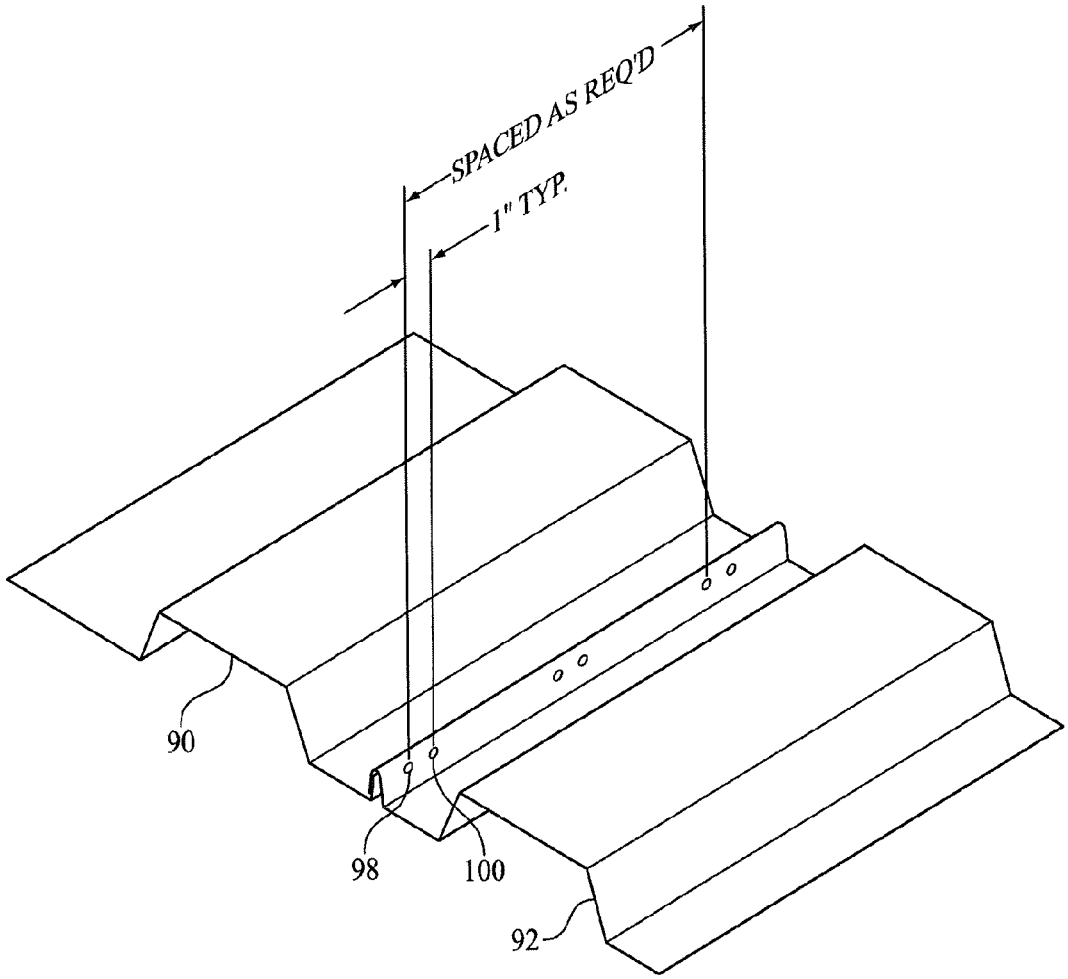
FIG. 16 is a perspective view of crimps according to the present invention installed in steel deck.

FIGS. 11-16 illustrate steel decking and the joining of two adjoining deck sections 90, 92 by the punch tool of the present invention. FIG. 11 illustrates that deck section 90 has an upwardly turned lip 92. Similarly deck section 92 has an inverted U-shaped section 96. The upward turned lip 92 is received in the interior of U-shaped section 96 so that deck sections 90 and 92 are loosely connected together at a seam which has a cross-section of three layers of sheet metal. In order to operate the punch tool of the present invention, an operator positions the punch tool over the interlocking decking seam to be crimped with the seam position between punch jaw base member 44 and die jaw base member 64. The operator then engages trigger assembly 22 causing air to enter the air bladder of actuator and the extension of the piston within the bladder. The piston pushes downwardly on clevis linkage 28. As a result, push links are activated so as to push on the first end of jaws, thus, causing jaws to pivot about pivot and the base members to be brought together to crimp the seam. FIG. 5 shows clevis linkage 28 in the lowered position with the jaws closed. After the crimping action is complete, the trigger assembly 22 is released allowing air to escape the valve 24 and the jaws to come apart.

For 22, 20 and 18 gage thicknesses, the first and second punches punch through the three layers of sheet metal from the same direction forming first and second penetrations 98, 100 with folds 102, 104 of alternating direction (FIGS. 12 and 13), the first penetration 98 with fold 102 oriented upwardly and the second penetration 100 with fold 104 oriented downwardly. The first and second penetrations 98, 100 with fold have a substantially semi-circular shape. The orientations of the punches 48, 50 allow the deck sheets to resist separation from vertical loading such as foot traffic and other construction loads. Both punches 48, 50 are rotated upwardly so that the tips 82 of the beveled portions are disposed above the lateral centerline of the punch (FIG. 14) for 16 gage thickness which is strong enough to resist the vertical construction loads, and the punch tool will not punch one up/one down.

Figure 2:
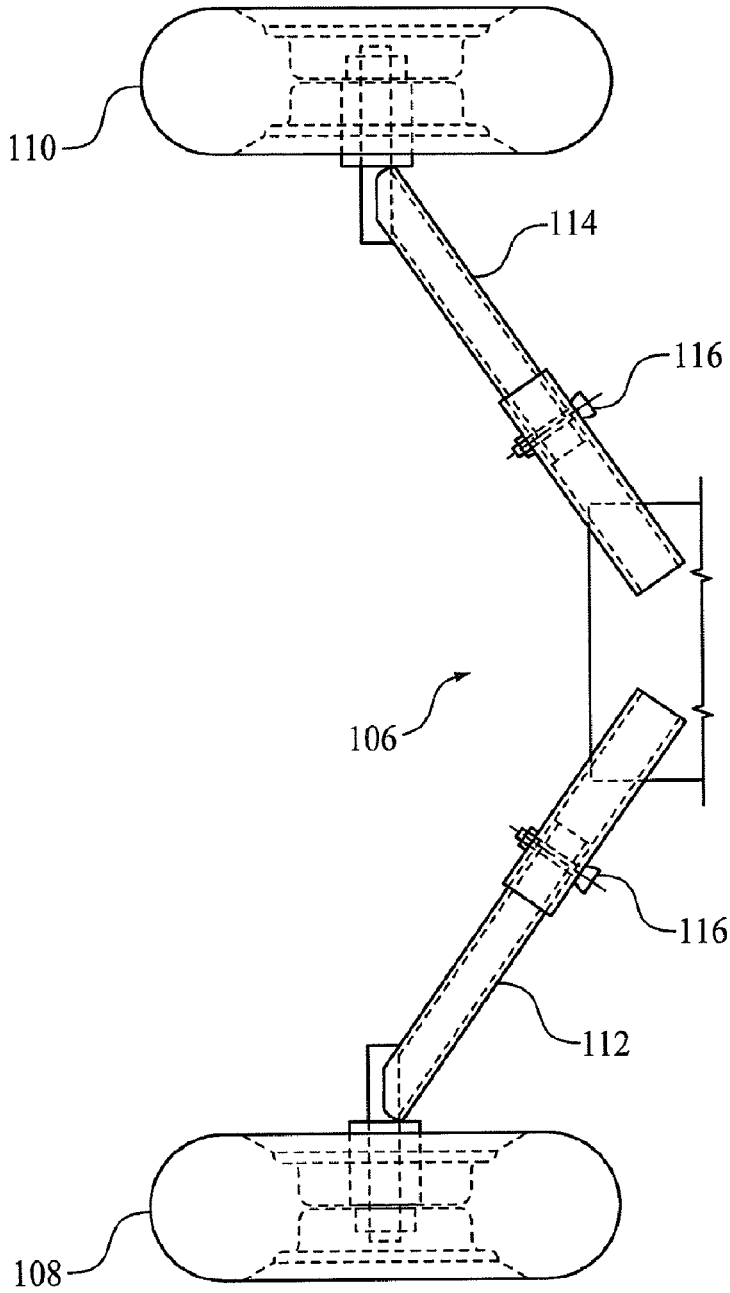
FIG. 2 is a rear view of the wheel section of the crimp tool.
Figure 3:
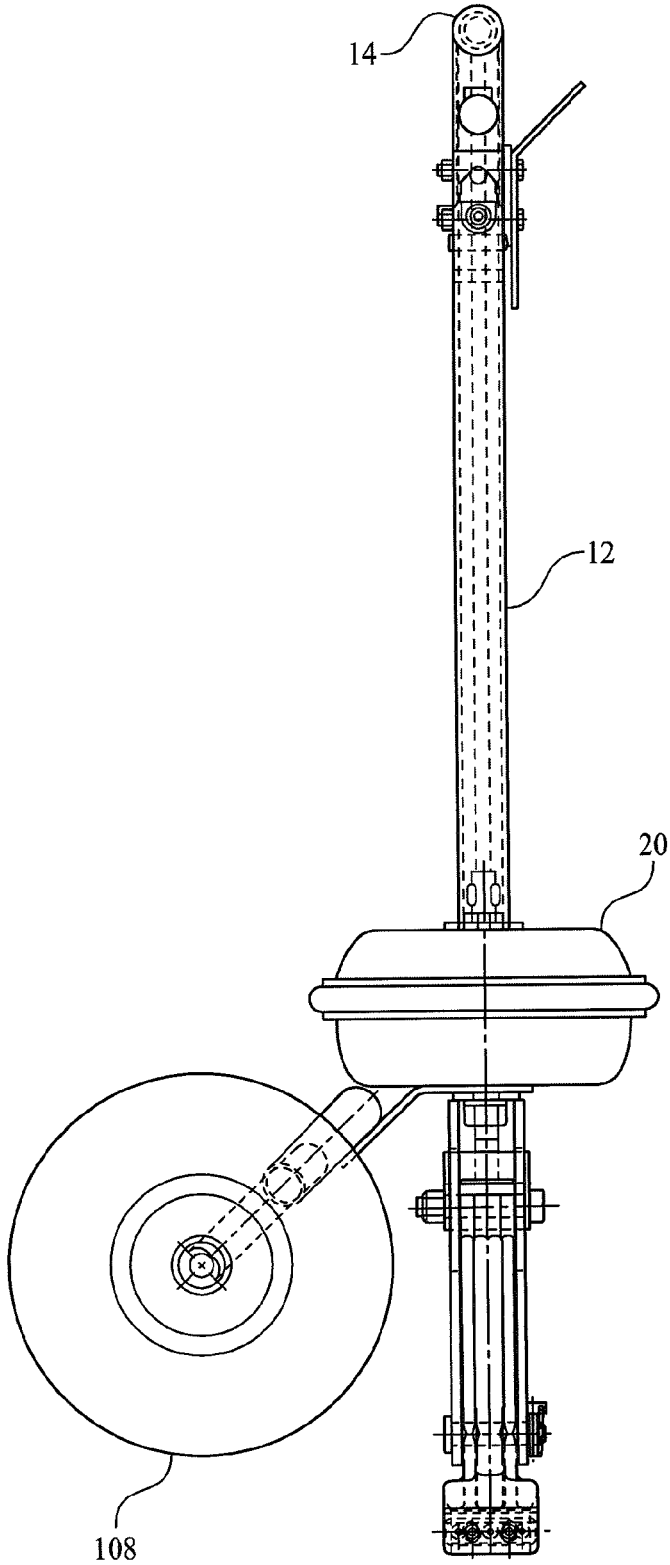
FIG. 3 is a side elevational view of the crimp tool shown in the upright position.

Also, the punch tool of the present invention preferably includes a wheel mounted support assembly 106. The punch tool of the present invention is preferably mounted on wheels 108, 110 (FIGS. 1-3). The wheels 108, 110 are mounted on arms 112, 114 which are connected to the tool frame by clip pins 116. This permits the wheels to be removed during shipment and situations where the wheels may interfere with an obstruction such as a wall or a beam. The purpose for the wheels 108, 110 is to keep the tool in an upright position and for ease of moving from one position to another. This permits the operator from continuously holding the tool and bending over to pick the tool up every time it is not in use, thus saving wear and tear on the tool from lying on the deck and the repetitive motion of the operator bending over and lifting and dragging the tool over the job site. Before the trigger assembly 22 is actuated, the wheels 108, 110 are lifted off of the steel deck by the operator to ensure the jaws are on bottom of the steel deck. After the tool has made a crimp, the wheels 108, 110 are lowered and the crimp tool is rolled along the two adjacent sheets of metal deck so as to be once again, activated to crimp.

Although the present invention has been described in detail for the purpose of illustration, it is to be understood that such detail is solely for that purpose and that variations can be made therein by those in the art without departing form the spirit and scope of the invention. For example, alternatively, the actuator may drive one of the jaws while the other is stationary.

What is claimed is:

1. A crimp tool for joining first and second adjoining steel decking sections at a decking seam by forming first and second spaced penetrations having folds in the decking seam, wherein the first and second spaced penetrations having folds are semi-circular, wherein the folds are oriented in opposite directions; the crimp tool comprising:

an actuator;

a punch jaw and a die jaw, each jaw having a first end and a second end, the jaws being pivotally connected to each other intermediate their first and second ends, at least one of the first ends of the jaws being operatively connected to the actuator;

first and second spaced punches on the second end of the punch jaw, each punch having a longitudinal axis parallel to the longitudinal axis of the other punch, each punch having a cylindrical end having a beveled tip extending substantially across the cross-section diameter of the cylindrical end for producing a semi-circular penetration having a fold in the decking seam, wherein the beveled tip of one of the punches is oriented upwardly and the beveled tip of the other punch is oriented downwardly with respect to the decking seam, wherein the semi-circular penetrations having folds produced by the first and second spaced punches are oriented such that one of the semi-circular penetrations having a fold is oriented upwardly and the other of the semi-circular penetrations having a fold is oriented downwardly with respect to the decking seam; and first and second spaced recesses on the second end of the die jaw in alignment with the first and second spaced punches, wherein, when the actuator is activated, the first and second spaced punches simultaneously punch through the decking seam from the same side of the decking seam to the first and second spaced recesses to form the semi-circular penetrations having folds.

2. The crimp tool of claim 1, wherein each punch comprises:

a cylindrical base portion adapted for attachment to the crimp tool;

a cylindrical end portion opposite the base portion;

wherein the end portion has a distal portion and an intermediate portion;

wherein the intermediate portion is disposed intermediate the distal portion and the base portion;

wherein the distal portion has a tip portion located at an outer diameter portion of the end portion;

wherein the distal portion has a first angled planar surface disposed at a first angle to the longitudinal axis;

wherein the intermediate portion has a second angled planar surface disposed at a second angle to the longitudinal axis, wherein the second angle is less than the first angle; and wherein the first angled planar surface and the second angled planar surface form a continuous beveled surface sloping downwardly across the entire cross-section diameter of the end portion from the tip portion located at an outer diameter portion of the end portion to an outer diameter of the base portion.

3. The crimp tool of claim 1, further comprising a wheel mounted support assembly mounted to the crimp tool having wheels adapted to move between a first position in which the wheels are on the decking sections for transporting the crimp tool alone the decking seam and a second position in which the wheels are lifted off of the decking sections when the crimp tool is actuated.

4. A crimp tool for joining first and second adjoining steel decking sections at a decking seam by forming first and second spaced penetrations in the decking seam, wherein the first and second spaced penetrations having folds are semi-circular; the crimp tool comprising:

an actuator;

a punch jaw and a die jaw, each jaw having a first end and a second end, the jaws being pivotally connected to each other intermediate their first and second ends, at least one of the first ends of the jaws being operatively connected to the actuator;

first and second spaced punches on the second end of the punch jaw, each punch having a longitudinal axis parallel to the longitudinal axis of the other punch, each punch comprising:

a cylindrical base portion adapted for attachment to the crimp tool;

a cylindrical end portion opposite the base portion;

wherein the end portion has a distal portion and an intermediate portion;

wherein the intermediate portion is disposed intermediate the distal portion and the base portion;

wherein the distal portion has a tip portion located at an outer diameter portion of the end portion;

wherein the distal portion has a first angled planar surface disposed at a first angle to the longitudinal axis;

wherein the intermediate portion has a second angled planar surface disposed at a second angle to the longitudinal axis, wherein the second angle is less than the first angle; and wherein the first angled planar surface and the second angled planar surface form a continuous beveled surface sloping downwardly across the entire cross-section diameter of the end portion from the tip portion located at an outer diameter portion of the end portion to an outer diameter of the base portion; and first and second spaced recesses on the second end of the die jaw in alignment with the first and second spaced punches, wherein, when the actuator is activated, the first and second spaced punches simultaneously punch through the decking seam from the same side of the decking seam to the first and second spaced recesses to form the semi-circular penetrations having folds.

5. The crimp tool of claim 4, wherein one of the beveled tips is oriented upwardly and the other of the beveled tips is oriented downwardly with respect to the decking seam.

6. The crimp tool of claim 4, wherein the beveled tips are oriented in the same direction with respect to the decking seam.

7. The crimp tool of claim 6, further comprising a wheel mounted support assembly mounted to the crimp tool having wheels adapted to move between a first position in which the wheels are on the decking sections for transporting the crimp tool along the decking seam and a second position in which the wheels are lifted off of the decking sections when the crimp tool is actuated.

8. A punch for use in a crimping tool for joining first and second adjoining steel decking sections at a decking seam by forming first and second semi-circular penetrations having folds in the seam, wherein the punch has a longitudinal axis, the punch comprising;

a cylindrical base portion adapted for attachment to the crimp tool;

a cylindrical end portion opposite the base portion;

wherein the end portion has a distal portion and an intermediate portion;

wherein the intermediate portion is disposed intermediate the distal portion and the base portion;

wherein the distal portion has a tip portion located at an outer diameter portion of the end portion;

wherein the distal portion has a first angled planar surface disposed at a first angle to the longitudinal axis;

wherein the intermediate portion has a second angled planar surface disposed at a second angle to the longitudinal axis, wherein the second angle is less than the first angle; and wherein the first angled planar surface and the second angled planar surface form a continuous beveled surface sloping downwardly across the entire cross-section diameter of the end portion from the tip portion located at an outer diameter portion of the end portion to an outer diameter of the base portion.

9. The punch of claim 8, wherein the base portion further comprises a pair of flanges adapted for attachment to the crimp tool.

10. A method of joining first and second adjoining steel decking sections at a decking seam by forming penetrations having folds in the decking seam, wherein the penetrations having folds are semi-circular, wherein the folds are oriented in opposite directions comprising:

positioning a crimp tool having a punch jaw and a die jaw over a decking seam to be crimped such that the punch jaw and the die jaw are on opposite sides of the decking seam, the punch jaw having first and second spaced punches, each punch having a cylindrical end having a beveled tip extending substantially across the cross-section diameter of the cylindrical end and wherein the beveled tip of one of the punches is oriented upwardly and the beveled tip of the other punch is oriented downwardly with respect to the decking seam, the die jaw having first and second spaced recesses in alignment with the first and second spaced punches;

actuating the actuator to cause the first and second punches to simultaneously penetrate the decking seam from the same side of the decking seam, the first and second punches producing first and second spaced semi-circular penetrations each having a fold in the decking seam, wherein the semi-circular penetrations having folds produced by the first and second spaced punches are oriented such that one of the semi-circular penetrations having a fold is oriented upwardly and the other of the semi-circular penetrations having a fold is oriented downwardly with respect to the decking seam.

11. The method of claim 10, wherein the crimp tool further comprises a wheel mounted support assembly mounted to the crimp tool, wherein the wheel mounted support assembly has wheels for supporting the crimp tool, wherein the step of positioning the crimp tool includes supporting the crimp tool on the wheels of the wheel mounted support assembly on the decking sections, wherein the method further comprises the step of lifting the wheels off of the decking sections prior to the step of actuating the actuator.

* * * * *